United States Patent [19]

Yamaguchi

[11] Patent Number: 4,718,866

[45] Date of Patent: Jan. 12, 1988

[54] ELECTRICAL CONNECTOR SHIELD CASE AND METHOD OF MAKING SAME

[75] Inventor: Masao Yamaguchi, Tokyo, Japan

[73] Assignee: Hirose Electric Co., Tokyo, Japan

[21] Appl. No.: 945,037

[22] Filed: Dec. 22, 1986

[30] Foreign Application Priority Data

Dec. 27, 1985 [JP] Japan ..... 60-292937

[51] Int. Cl.[4] ..... H01R 13/648

[52] U.S. Cl. ..... 439/607; 29/874; 72/379

[58] Field of Search ..... 339/14 R, 143 R, 136 R, 339/136 M, 142; 439/108, 607–610; 29/874; 72/379

[56] References Cited

U.S. PATENT DOCUMENTS 2,790,153 4/1957 Arson ..... 339/136 M
4,512,618 4/1985 Kumar ..... 339/14 R
4,602,838 7/1986 Davis et al. ..... 339/143 R
4,637,669 1/1987 Tajima ..... 339/14 R

*Primary Examiner*—John McQuade
*Attorney, Agent, or Firm*—Yusuke Takeuchi

[57] ABSTRACT

An electrical connector shield case for covering either protuberance or opening of an insulating housing with a plurality of contacts therein, which comprises a cylindrical metal member; at least one boss provided on the side of said cylindrical member so as to make shielding contact with the shield member of another connector; and latch means provided on said cylindrical side for engaging with said insulating housing. A method of making such an electrical connector shield case, which comprises the steps of punching out a metal sheet with at least one boss and latch means; bending opposite ends of said metal sheet upright; and bending said opposite ends inward to form a cylindrical shield case.

6 Claims, 18 Drawing Figures

ELECTRICAL CONNECTOR SHIELD CASE AND METHOD OF MAKING SAME

BACKGROUND OF THE INVENTION

1. Field of the Invention

The present invention relates to electrical connector shield cases and methods of making them, more particularly to an electrical connector shield case for covering the insulating housing of a plug or receptacle connector to make shielding contact to the shield member of another connector and a method of making it.

2. Description of the Prior Art

Referring to FIG. 6A there is shown an electrical connector shield case 100' according to the prior art. In FIG. 6B, a base 103' of this shield case is secured to an insulating housing having male contacts 101' through an intermediate plate 102' so that the male contacts can be housed in an enclosure 104' which is integral with the base 103'. In use, the female contact of another connector is inserted into the enclosure 104' so that inner bosses 105' of the enclosure 104' can be brought into shielding contact with a shield member, such as a metal case, of the other connector.

As FIGS. 7A through 7F show, the shield case 100' has been manufactured by pressing a metal sheet 10' having a size corresponding to that of the final product. A shield case element 40' is made by pressing the metal sheet 10' by means of a drawing press consisting of the lower die 20' with a projection 21' having a shape substantially identical with the shape of the enclosure 104' and the upper die 30' with a depression 31' having a shape substantially identical with the shape of the enclosure 104' (FIGS. 7B and 7C). The resulting shield case element 40', with a protruded portion 41' and a flange portion 42' is then pressed in another press consisting of the lower die 50' with a projection 51' having a cross section substantially identical with that of the protruded portion 41' and a depression 52' shaped corresponding to the periphery of the base 103' and the upper die 60' with a depression 61' having a cross section substantially identical with that of the protruded portion 41' and a projection 62' shaped corresponding to the periphery of the base 103' to open the top of the protruded portion 41' and cut the flange portion 42' to a predetermined shape (FIG. 7E). Then, bosses 105' are made by inserting a core die 70' having recesses 71' at positions corresponding to the bosses 105' of the shield case 100' into the protruded portion 41' of the shield case 100' and pressing the work between a pair of outer dies 80' and 90' each having projections 81' or 91' at positions corresponding to the bosses 105' in the direction of an arrow shown in FIG. 7F. This completes the formation of a shield case 100' such as shown in FIG. 6A.

The manufacture of the above prior electrical connector shield case requires the drawing pressing porcess and has the following drawbacks:

(1) The amount of material loss is large, increasing the material cost;

(2) An extensible, soft material must be used, limiting the range of choices in material and failing to give satisfactory elasticity to the bosses of a case;

(3) The extensible, soft material is susceptible to deformation under an external stress;

(4) The thickness of a case wall varies from section to section.

(5) The outward bosses are very difficult to make.

SUMMARY OF THE INVENTION

According to one aspect of the invention there is provided an electrical connector shield case for covering either protuberance or opening of an insulating housing with a plurality of contacts therein, which comprises (a) a cylindrical metal member; (b) at least one boss provided on the side of said cylindrical member so as to make shielding contact with the shield member of another connector; and (c) latch means provided on said cylindrical side for engaging with said insulating housing.

In accordance with another aspect of the invention there is provided an electrical connector shield case wherein said latch means consists of a latch claw provided on said cylindrical side and a flange of said insulating housing.

According to still another aspect of the invention there is provided an electrical connector shield case wherein said latch means consists of a tab provided on said cylindrical side and a slot provided on said insulating housing, into which said tab is fitted.

In accordance with yet still another aspect of the invention there is provided an electrical connector shield case wherein said tab has an extended end to be snapped into said slot.

According to still another aspect of the invention there is provided a method of making an electrical connector shield case for covering either protuberance or opening of an insulating housing with a plurality of contacts arranged therein, which comprises the steps of (a) punching out a metal sheet with at least one boss and latch means; (b) bending opposite ends of said metal sheet upwright; and (c) bending said opposite ends inward to form a cylindrical shield case.

Other features and advantages of the present invention will be apparent from the following description of the preferred embodiments with reference to the accompanying drawings.

DESCRIPTION OF THE PREFERRED EMBODIMENTS

Figure 1:
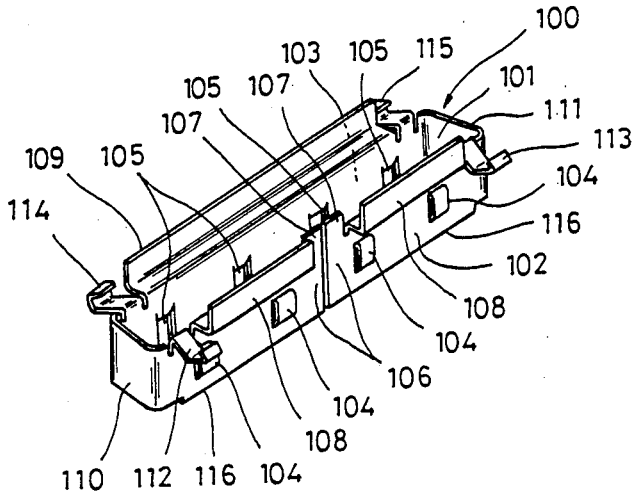
FIG. 1 is a perspective view of an electrical connector shield case embodying the present invention.

Referring now to FIG. 1 there is shown an electrical connector shield case 100 formed according to the present invention so as to define a space 101 having a trapezoidal section. Its parallel major sides 102 and 103 have bosses 104 and 105, respectively, projecting outward. The major side 102 has at its center a pair of mating portions 106 each with an engaging tab 107 which is extended upward. The major side 102 has along its upper edge a pair of enclosing flanges 108 curved outward and then upward. The major side 103 has along its upper edge an enclosing flange 109 curved outward and then upward. The major side 102 has a latch claw 112 between the enclosing flange 108 and the minor side 110 and a latch claw 113 between the enclosing flange 108 and the minor side 111, while the major side 103 has a latch claw 114 between the enclosing flange 109 and the minor side 110 and a latch claw 115 between the enclosing flange 109 and the minor side 111. The major side 102 has a pair of stopper flanges 116 bent inward along its lower edge, while the major side 103 has an stopper flange 117 bent inward along its lower edge.

Figure 2:
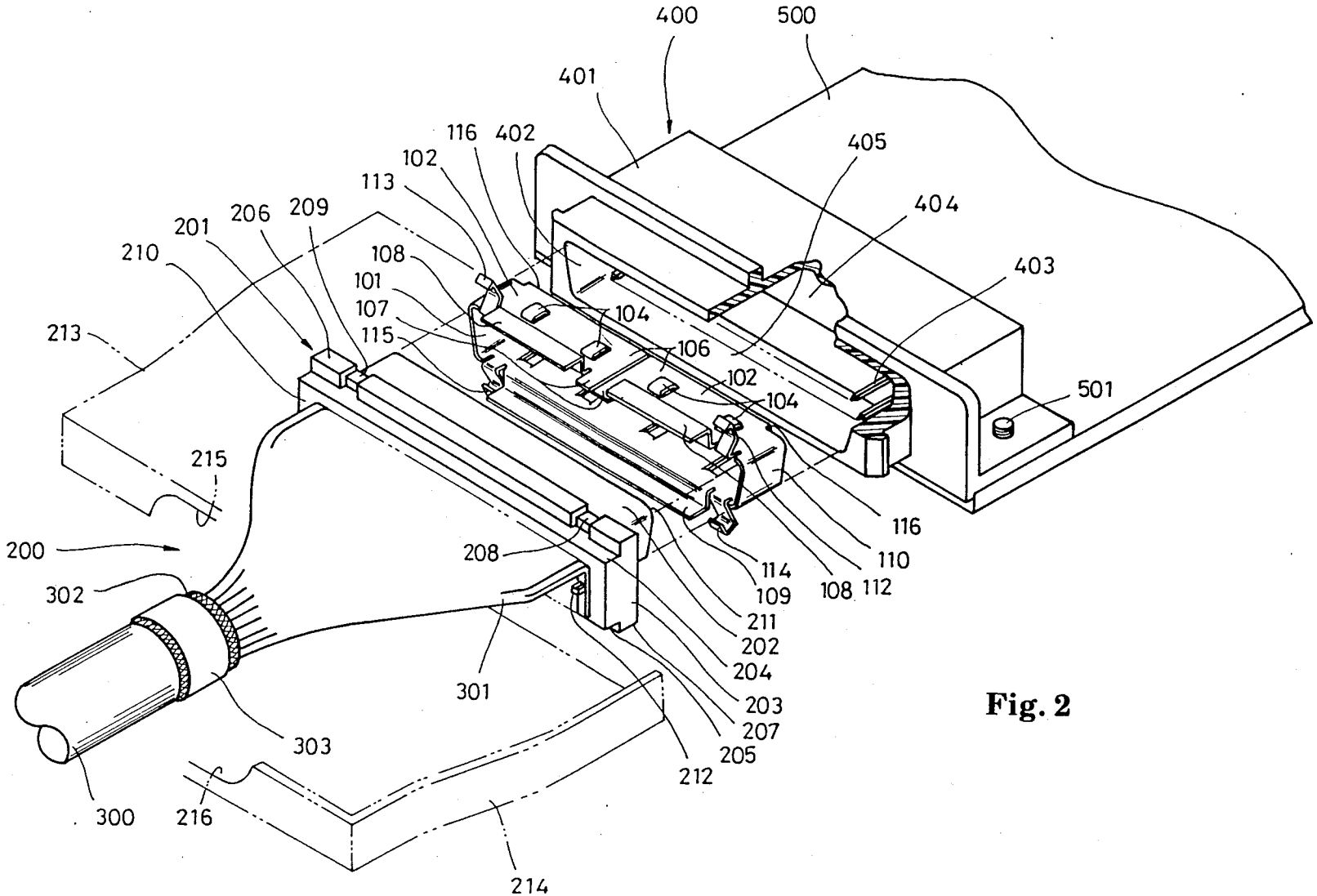
FIG. 2 is an exploded perspective view of part of the electrical connector employing the shield case of FIG. 1.

Referring to FIG. 2 there is shown a plug connector 200 having an insulating housing 201 to which the shield case 100 according to the present invention is applied. The insulating housing 201 has a fitting protuberance 202 having a section similar to that of the space 101 and a base portion 203 integral with the fitting protuberance 202 and having a section greater than that of the protuberance. The base portion 203 has a pair of flanges 206 and 207 on its upper and lowr major sides 204 and 205. The flange 206 has a pair of notches 208 and 209 with which the respective claws 112 and 113 and the flange 207 has a pair of notches (not shown) for the claws 114 and 115. The fitting protuberance 202 is adapted to fit into the enclosure defined by the major sides 102 and 103 and the minor sides 110 and 111 of the shield case 100. The front edges of the fitting protuberance 202 engage with the stop flanges 116, 117. The engaging tab 107 is inserted into a slot (not shown) opened through the flange 206 into the base 203. An end 212 of a female contact (not shown) is projected from the rear side 210 of the base 203 and is connected to a core wire 301 of a shield cable 300.

A pair of metal plug case halves 213 and 214 are adapted to house the base 203 and the flange 206 in such a manner that the fitting protuberance 202 may be projected from the case. Portions of the plug case inside adjacent to the flange 206 are brought into contact with the enclosing flanges 108 and 109 and the latch claws 112 to 115 thereby to secure shielding function. The case halves 213 and 214 have cutouts 215 and 216, respectively, to allow insertion of the shield cable 300. The insides of the cutouts 215 and 216 are brought into contact with a conductive tape 303 wrapped around a folded shield sheat 302 to secure shielding function.

The above plug connector is adapted to insert into a receptacle connector 400 with a receptacle case 401 secured to a circuit board 500 with a screw 501. The receptacle case has an opening 402 for receiving the protuberance 202 of the plug connector 200. Within the opening 402 there are provided a plurality of male contacts 403 so that they may come into contact with the female contacts placed in the holes of the other face of the protuberance 202. The base of each male contact 403 is inserted into a hole (not shown) of an insulating housing 404 within the receptacle case 401 and connected to a appropriate element (not shown) on a circuit board 500. When the plug connector 200 is inserted into the opening 402, the bosses 104 and 105 of the shield case 100 are brought into contact with the inside 405 of the opening to provide shielding function.

Figure 3A:
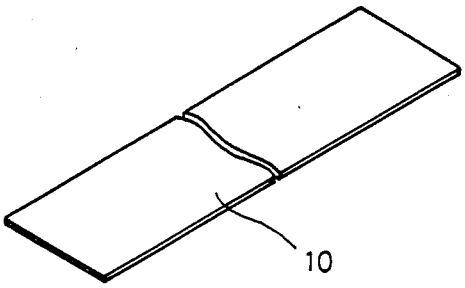
FIGS. 3A–3F illustrate a method of making the shield case of FIG. 1.
Figure 3B:
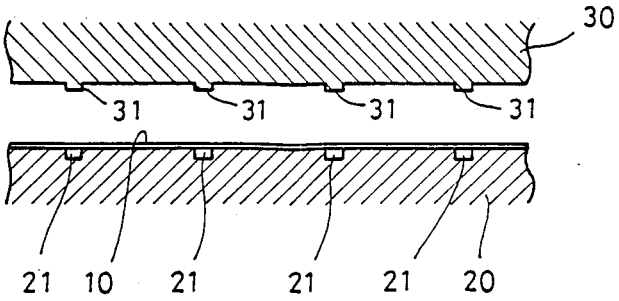
Figure 3C:
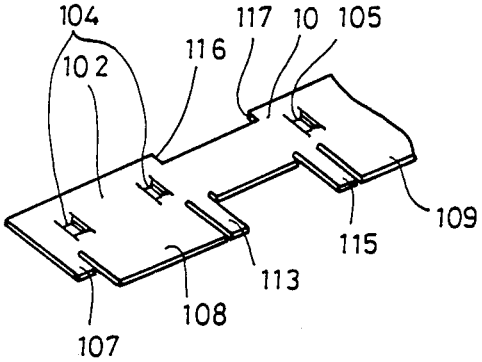

FIGS. 3A–3F illustrate a method of making the electrical connector shield case according to the invention. A metal sheet 10 with dimensions corresponding to those of a final product or electrical connector shield case 100 is placed on the lower die 20 with depressions 21 and other depressions (not shown) provided at the positions corresponding to the bosses 104 and 105 and the parts to be cut off, respectively, and the upper die 30 with projections 31 and other projections (not shown) provided at the positions corresponding to the bosses 104 and 105 and the parts to be cut off, respectively, is pressed against the lower die 20 (FIGS. 3A and 3B) to form bosses 104 and 105, tab 107, enclosing flanges 108 and 109, latch claws 112, 113, 114, and 115, and stop flanges 116 and 117 (FIG. 3C).

Figure 3D:
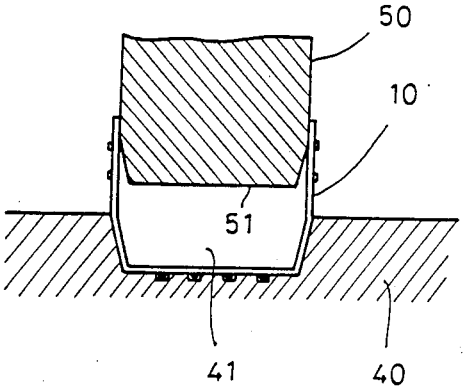
Figure 3E:
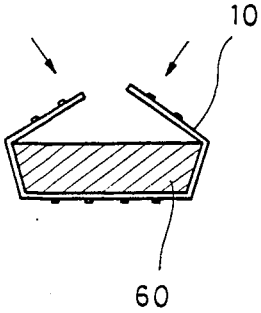
Figure 3F:
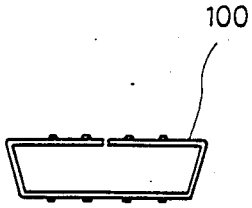

The metal sheet 10 is then placed on the die 40 with a depression 41, and the upper die 50 with a projection 51 having a shape corresponding to the depression 41 is pressed down (FIG. 3D). The core die 60 with a shape substantially identical with that of the space 101 is then placed on the central part of the metal sheet 10, and the opposite ends of the sheet 10 are pressed in the directions of arrows (FIG. 3E). After the pressing, the core die 60 is removed to provide an electrical connector shield case 100 made according to the invention (FIG. 3F).

Figure 4:
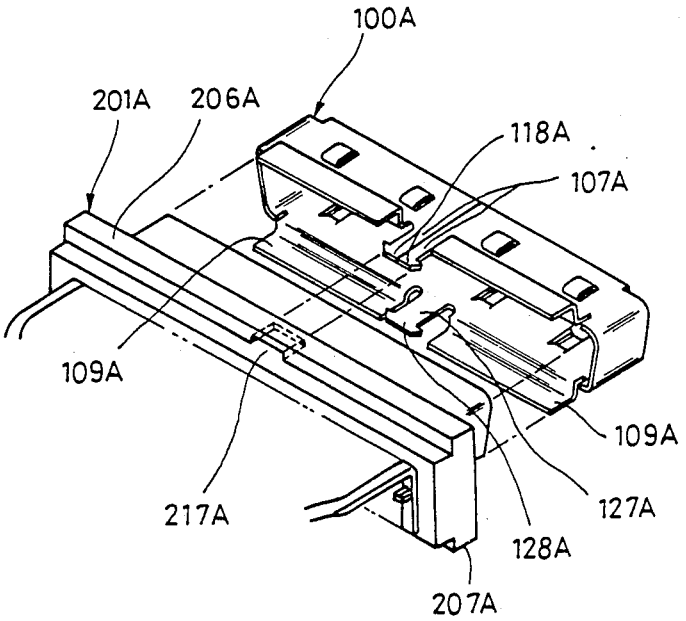
FIG. 4 is an exploded perspective view of part of an electrical connector employing another embodiment of the shield case according to the invention.

The above electrical connector shield case 100 has latch claws 112 through 115 to engage the notches 208 and 209 of the insulating housing 201, but these claws 112 through 115 and notches 208 and 209 may be eliminated as shown in FIG. 4. This electrical connector shield case 100A has an engaging tab 107A with an extended end 128A and an engaging tab 127A with an extended end 128A provided at the center of the enclosing flange 109A. The shield case 100A is applied to a plug connector 201A with flanges 206A and 207A each having engaging slot 217A. Each of the engaging tabs 107A and 127A is snapped into the engaging slot 217A so that its extended end 128A may rest on the flange. The other structures are identical with those of FIGS. 1 through 3, and their description will be omitted.

The above electrical connector shield case 100 or 100A is fitted over the protuberance 202 of a plug connector and is brought into contact with the shield member, such as the metal case, of a receptacle connector to secure shielding function when it is inserted into the receptacle connector. This sytem, however, requires that the receptacle case be made of conductive metal, increasing the number of parts. Thus, the receptacle case 401 of a receptacle connector 400 is made of insulating material, with a shield case placed within its opening 402 as described below with reference to FIG. 5.

Figure 5:
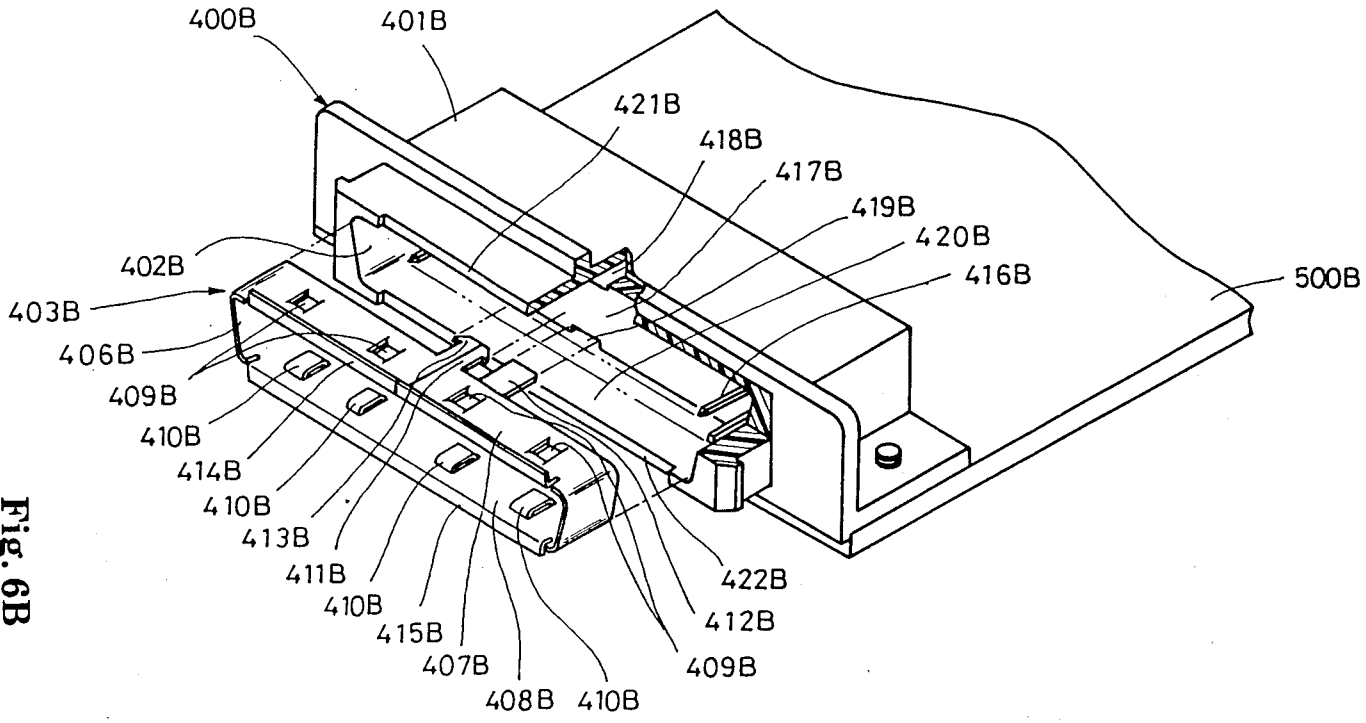
FIG. 5 an exploded perspective view of part of an electrical connector employing still another embodiment of the shield case according to the invention.
Figure 6A:
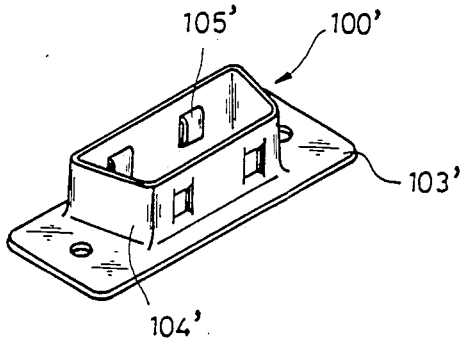
Fig. 6A PRIOR ART
FIGS. 6A–6B are perspective views of a shield case of the prior art.
Figure 6B:
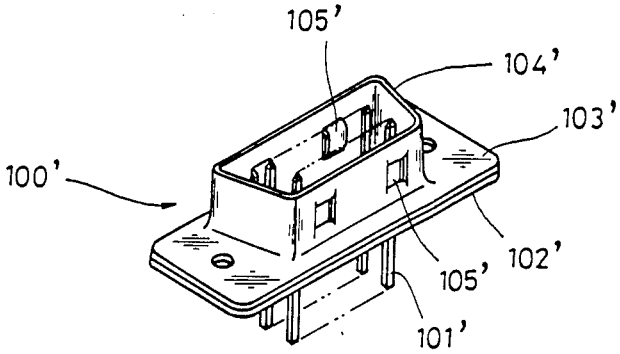
Fig. 6B PRIOR ART
Figure 7A:
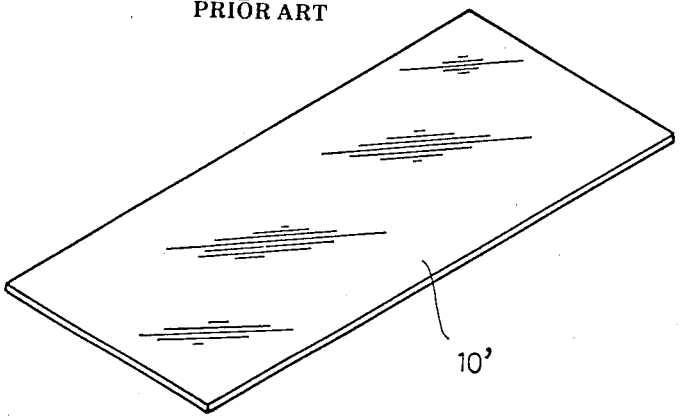
Fig. 7A PRIOR ART
FIGS. 7A–7F illustrate a method of making the shield case of FIG. 6A according to the prior art.
Figure 7B:
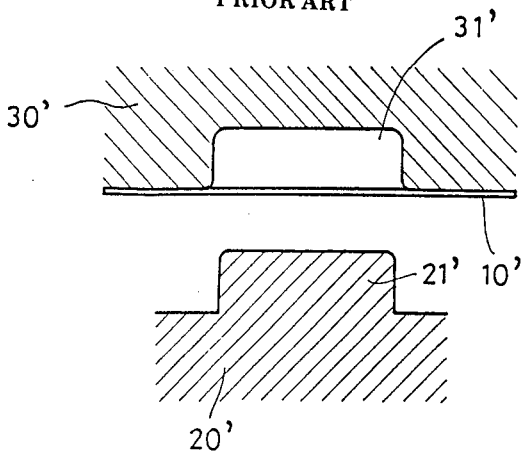
Fig. 7B PRIOR ART
Figure 7C:
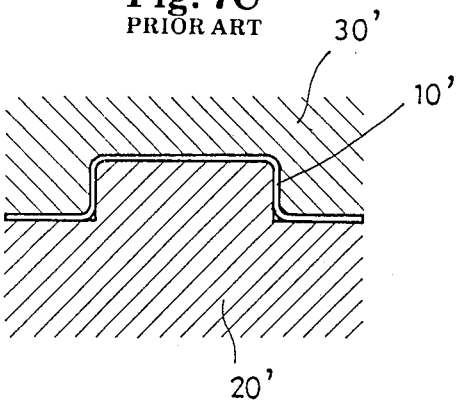
Fig. 7C PRIOR ART
Figure 7D:
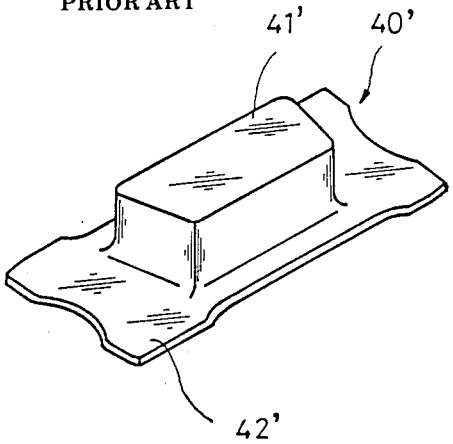
Fig. 7D PRIOR ART
Figure 7E:
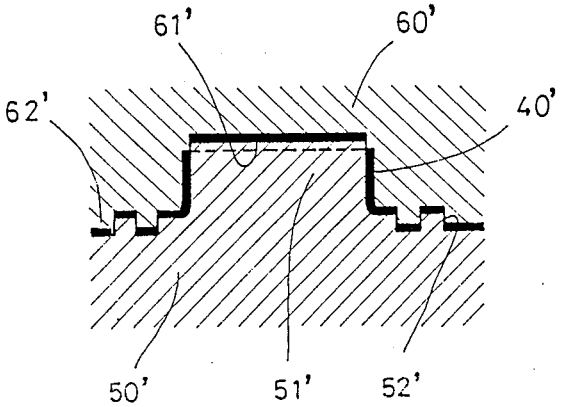
Fig. 7E PRIOR ART
Figure 7F:
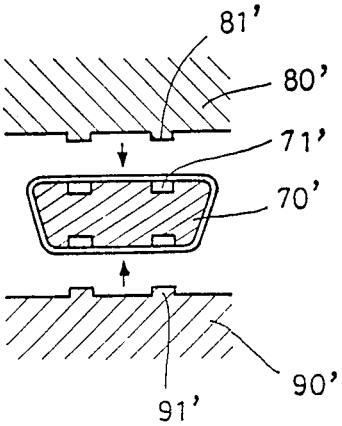
Fig. 7F PRIOR ART

In FIG. 5, a shield case 403B defines a space 406B with a trapezoidal cross section substantially identical with that of an opening 402B and has bosses 409B and 410B on the insides of its major sides 407B and 408B. The major sides 407B and 408B have engaging tabs 411B and 412B, respectively, on their rear edges. The engaging tab 411B has an extended end 413B. The major sides 407B and 408B have flanges 414B and 415B, respectively, along their front edges. The receptacle case 401B has a number of male contacts 416B arranged on its base part within the opening 402B and, at the central parts on opposite major insides, a snap slot 418B into which the snap tab 411B is snapped and a slot 419B into which the tab 412B is inserted. After inserted, the free end of the tab 412B is bent and connected to a circuit board 500B to secure shield function. The edges of the opening 402B have cutouts 421B and 422B for receiving the flanges 414B and 415B, respectively.

The shield case for covering the protuberance of a plug connector to be inserted into the opening 402B of this receptacle requires no bosses on its surface to secure shielding function because of the presence of bosses 409B and 410B on the shield case 403B. Alternatively, these bosses 409B and 410B may be eliminated from the shield case 403B by providing bosses on the shield case of a plug connector. The other structures of the plug connector are similar to those of FIGS. 1 through 4, and their description will be omitted.

As has been described above, according to the invention, a metal sheet may be punched out and bent to form a cylindrical electric connector shield case to eliminate the drawing press process and the metal sheet deformation in connection with the process, thus increasing the material utility. In addition, since no drawing press is used, it is unnecessary to use any extensible, soft material, thus allowing the formation of resilient bosses and eliminating the deformation caused by the excess external force otherwise required. Moreover, the wall thickness is even in every section, giving high precision. The direction of a protuberance is selectable, too.

Although the preferred embodiments of the present invention have been described above, other embodiments and modifications which would be apparent to one having ordinary skill in the art are intended to be covered by the spirit and scope of the appended claims.

What is claimed is:

1. An electrical connector shield case for covering a protuberance of an insulating housing with a plurality of contacts therein, which comprises:

a cylindrical metal member with parallel major sides, one of which has a pair of mating portions;

at least one boss projected outwardly from at least one of said major sides so as to make shielding contact with a shield member of another connector;

a pair of engaging means each extending from an edge of a said mating portion for engagement with said insulating housing so that said mating portions are brought into close contact with each other.

2. An electrical connector shield case as recited in claim 1, which further comprises a pair of latch means extending from opposite ends of each of said major sides for engagement with said insulating housing.

3. An electrical connector shield case as recited in claim 1, wherein said engaging means is made in the form of a generally rectangular tab.

4. An electrical connector shiled case as recited in claim 3, wherein said tab has an extended end to latch said shield case to said insulating housing.

5. A method of making an electrical connector shield case for covering either protuberance or opening of an insulating housing with a plurality of contacts arranged therein, which comprises the steps of:

(a) punching out a generally rectangular metal sheet with a pair of mating portions at opposite ends, at least one boss, and a pair of engaging means each extending from an edge of a said mating portion;

(b) bending opposite end portions of said metal sheet upright; and (c) bending said opposite end portions inward to form a cylindrical shield case in such a manner that said mating portions may be brought into close contact with each other when said engaging means engage said insulating housing.

6. An electrical connector shield case for covering an opening of an insulating housing with a plurality of contacts therein, which comprises:

a cylindrical metal member with a pair of parallel major sides, one of which has a pair of mating portions;

at least one boss projected inwardly from at least one of said major sides so as to make shielding contact with a shield member of another connector; and a pair of engaging means each extending from an edge of a said mating portion for engagement with said insulating housing so that said mating portions are brought into close contact with each other.

* * * * *